US005526776A

United States Patent [19]

Fenn et al.

[11] Patent Number: 5,526,776

[45] Date of Patent: Jun. 18, 1996

[54] GAS QUICK WATER HEATER

[75] Inventors: Gordon W. Fenn, Brevard, N.C.; Young M. Ryoo; Min H. Oh, both of Ansan, Rep. of Korea; Hong J. Kim, Inchon, Rep. of Korea

[73] Assignee: Frontier, Inc., Ann Arbor, Mich.

[21] Appl. No.: 413,181

[22] Filed: Mar. 30, 1995

[51] Int. Cl.[6] ..... F22B 23/06

[52] U.S. Cl. ..... 122/367.3; 122/367.1; 122/16; 126/351

[58] Field of Search ..... 126/350 R, 351, 126/374; 122/367.1, 367.3, 15, 16, 13.1, 17

[56] References Cited

U.S. PATENT DOCUMENTS

| | | | |
|---|---|---|---|
| 1,353,174 | 9/1920 | Mayers | 126/351 |
| 4,055,152 | 10/1977 | Vidalenq | 122/367.3 |
| 4,679,528 | 7/1987 | Krans | 122/367.3 |
| 5,311,843 | 5/1994 | Stuart | 122/367.3 |
| 5,365,887 | 11/1994 | Fenn | 122/367.1 |

*Primary Examiner*—James C. Yeung
*Attorney, Agent, or Firm*—George L. Boller

[57] ABSTRACT

A gas quick water heater is disclosed which includes a heat exchanger having an annular lower manifold with a cold-water intake, an annular upper manifold with a hot-water exit, a plurality of coil-shaped heat exchanging tubes connected between the manifolds, and a baffle plate installed in the center of the heat exchanging tubes and for delaying the flow of heated air; an inner liner for closely embracing the inner surface of the heat exchanging tubes of the heat exchanger; an outer liner designed higher than the inner liner in height and for closely embracing the outer surface of the heat exchanging tubes; a lower plate for closing a lower portion between the inner and outer liners and having an air intake at the center; a swirl plate having a plurality of air intakes at the periphery and a gas hole at the center portion; a combustion barrel having a plurality of air intakes on the overall surface; an insulation member in which the top surface is closed and the lower surface is opened to form an annular air intake; and an exhaust fan for discharging burned gas through the opening of the outer liner and the exhaust port of the barrier.

7 Claims, 3 Drawing Sheets

GAS QUICK WATER HEATER

BACKGROUND OF THE INVENTION

The present invention relates to a gas quick water heater, and more particularly, to a gas quick water heater which employs a counter-flow method in which the direction of heat flow is opposite to the direction of water flow to be heated, and which indirectly heats a heat exchanger.

A general gas quick water heater, as shown in FIG. 1, directly heats a heat exchanging tube 2, through which cold water introduced through a water supply pipe 1 flows, with a burner 3 so that the cold water is heated. The heated water is supplied via a hot-water pipe 4.

However, in such a gas quick water heater, the flame of burner 3 is applied directly to heat exchanging tube 2 which is corroded due to high temperature, shortening the life of the gas quick water heater. Further, the heater has no means for completely burning harmful gas such as carbon monoxide and nitrogen oxide produced during a gas combustion, thereby decreasing the combustion efficiency and creating environmental pollution. This is dangerous for poisoning due to the harmful gases. Moreover, in the heater, the heat of burner 3 is designed to focus on the fin of short-length heat exchanging tube 2 and transmit the heat of the fin to water via heat exchanging tube 2, thereby increasing a heat loss.

Furthermore, the hot water discharged from hot-water pipe 4 cannot be supplied at more than one temperature. However, a temperature of hot water in taking a shower and a temperature of hot water in washing dishes are different. Therefore, it is desirable that when taking a shower and washing dishes at the same time, the hot water discharged from heat exchanging tube 2 should be supplied at two different temperatures. Since the conventional gas quick water heater supplies hot water at a single temperature, it is uneconomic to supply high-temperature hot water even in washing dishes. However, lower-temperature hot water can be used in washing dishes.

U.S. Pat. No. 5,365,887 discloses a gas quick water heater in which a heat exchanger is indirectly heated in a counter-flow method, heating cold water at a higher heat efficiency and thereby increasing the life of the heat exchanger. However, this heater does not overcome other problems and has not improved sharply heat efficiency and the life of heat exchanger.

SUMMARY OF THE INVENTION

Therefore, in order to solve the above-discussed drawbacks, it is an object of the present invention to provide a gas quick water heater having a greatly improved heat efficiency.

It is another object of the present invention to provide a gas quick water heater which perfectly prevents a heat exchanger from being corroded by high temperature, sharply increasing the life of the heat exchanger.

It is still another object of the present invention to provide a gas quick water heater which perfectly burns imperfectly burned gas using a catalyzer, to thereby enhance combustion efficiency and simultaneously prevent environmental pollution.

It is yet another object of the present invention to provide a gas quick water heater which can control the rotation speed of an exhaust fan and the supply amount of gas in proportion to the flow amount of hot water being used and an established temperature of hot water, thereby heating cold water at an optimal efficiency.

It is still yet another object of the present invention to provide a gas quick water heater which can supply hot water at more than one temperature.

To accomplish the objects of the present invention, there is provided a gas quick water heater generally comprising: a casing divided into first and second spaces by a barrier; a heat exchanger installed in the second space and having an annular lower manifold with a cold-water intake, an annular upper manifold with a hot-water exit, a plurality of coil-shaped heat exchanging tubes connected between the manifolds, and a baffle plate installed in the center of the heat exchanging tubes and for delaying the flow of heated air; an inner liner for closely embracing the inner surface of the heat exchanging tubes of the heat exchanger; an outer liner placed higher than the inner liner and for closely embracing the outer surface of the heat exchanging tubes; a lower plate for closing a lower portion between the inner and outer liners and having an air intake at the center; a swirl plate installed at the middle of the inner liner and having a plurality of air intakes at the periphery and a gas hole at the center portion; a combustion barrel installed in the swirl plate, spaced apart from the inner liner by a predetermined distance, and having a plurality of air intakes on the overall surface; a burner installed in the combustion barrel; an insulation member spaced apart from the outer side surface and top of the outer liner by a predetermined distance and in which the top surface is closed and the lower surface is opened to form an annular air intake; and an exhaust fan installed in the first space and for discharging burned gas through the opening of the outer liner and the exhaust port of the barrier.

In the present invention, a catalyst for accelerating the combustion of imperfectly burned gas is provided on the upper portion of the combustion barrel.

Further, a flow amount detector is installed on a cold-water supply pipe to control the rotation speed of the exhaust fan and a gas supply amount in proportion to the flow amount of water detected by the flow amount detector so that cold water can be heated at an optimal efficiency.

A mixing valve which can simply supply hot water or supply the hot water with cold water mixed is installed to supply two kinds of hot water of different temperatures.

BRIEF DESCRIPTION OF THE ATTACHED DRAWINGS

DETAILED DESCRIPTION OF THE INVENTION

Hereinafter, a preferred embodiment of a gas quick water heater of the present invention will be explained in detail with reference to the attached drawings.

Figure 2:
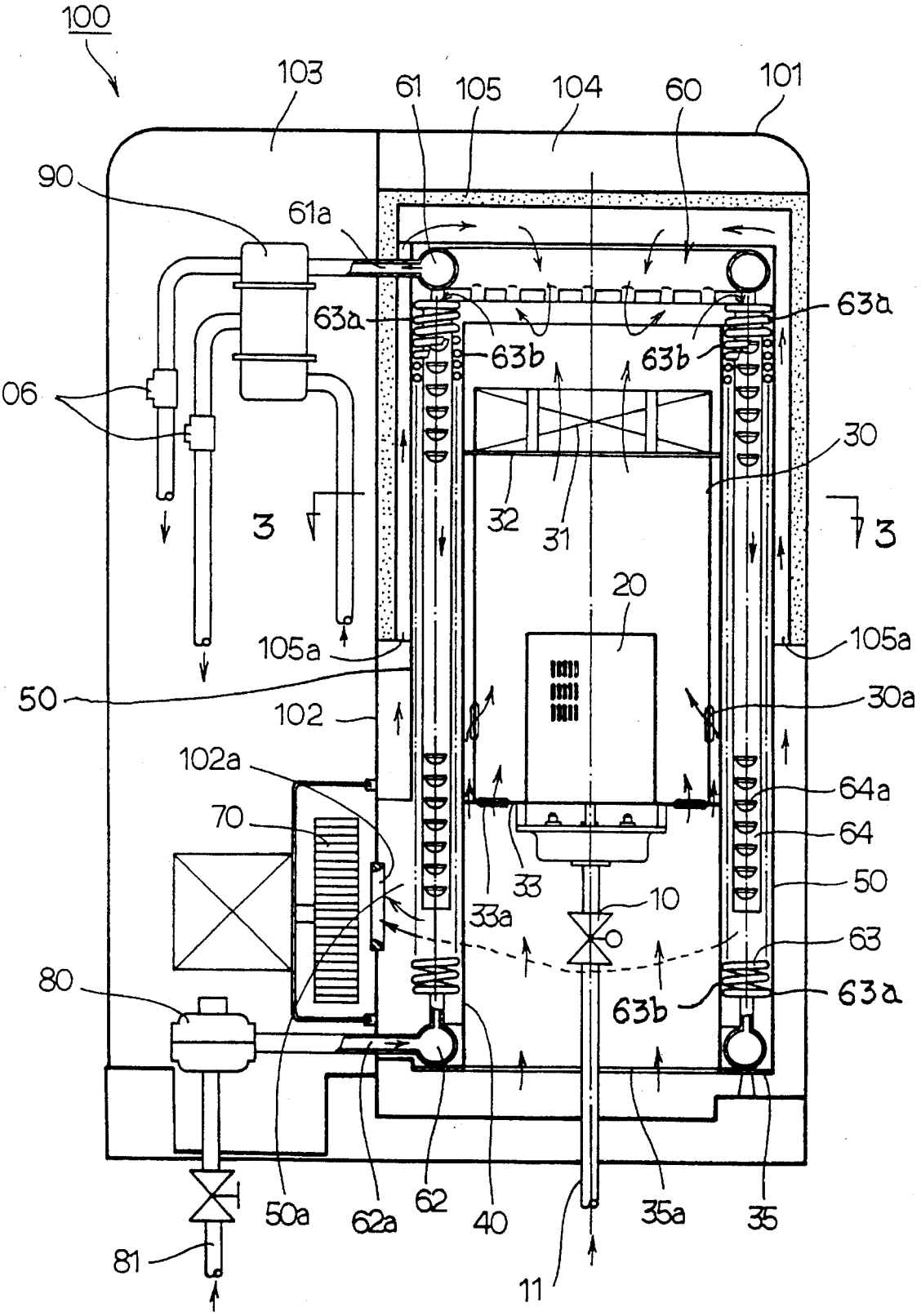
FIG. 2 is a schematic configuration view of a gas quick water heater of the present invention.

As depicted in FIG. 2, in a gas quick water heater of the present invention, a casing 101 is divided into a first space 103 and a second space 104 by a barrier 102. First space 103 comprises a flow amount detector 80 for detecting the amount of cold water entered, an exhaust fan 70 for forcibly discharging burned gas, a mixing valve 90 for supplying hot water at two kinds of temperature, and thermistors 106 for detecting the temperature of each kind of hot water discharged from mixing valve 90.

Second space 104 comprises a burner/heat exchanger which burns gas supplied through gas supply pipe 11 and performs heat exchange between the burned gas and cold water.

A heat exchanger 60 installed inside second space 104 comprises an annular upper manifold 61 having a hot-water exit 61*a*, an annular lower manifold 62 having a cold-water intake 62*a*, and a plurality of coil-shaped heat exchanging tubes 63 connected between upper and lower manifolds 61 and 62. Cold water of a cold-water supply pipe 81 enters lower manifold 62 through cold-water intake 62*a* and flows through upper manifold 61 via the plurality of heat exchanging tubes 63. Then, the water is discharged to mixing valve 90 through hot-water exit 61*a*.

At the center of the plurality of heat exchanging tubes 63 is installed respectively a baffle plate 64 in which a plurality of wings 64*a* are bent toward both sides in a ribbon-shaped metal plate. Baffle plate 64 delays the traveling speed of burned gas flowing through the space surrounded by coils of each of the heat exchanging tubes 63.

Figure 1:
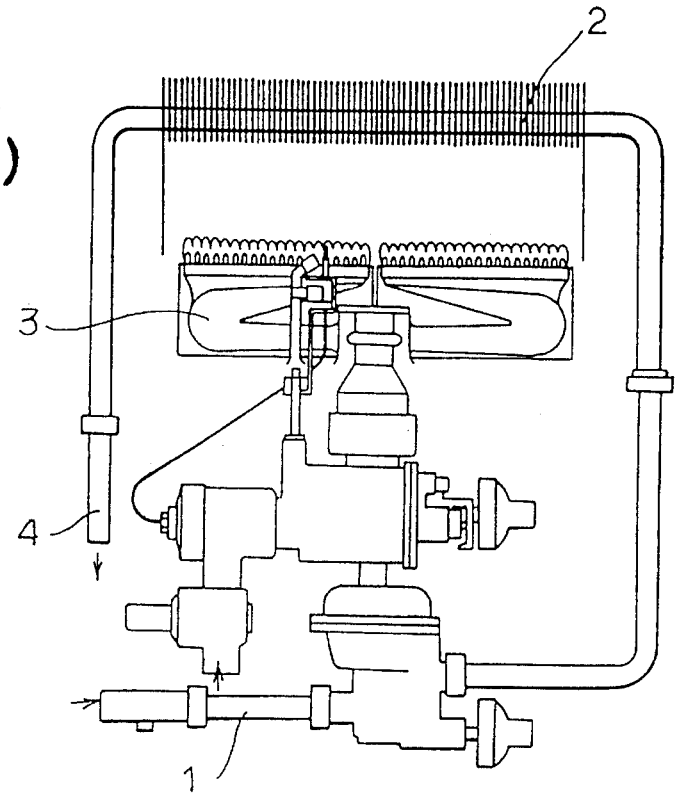
FIG.1 (PRIOR ART)
FIG. 1 is a schematic configuration view of a general prior art gas quick water heater.
Figure 3:
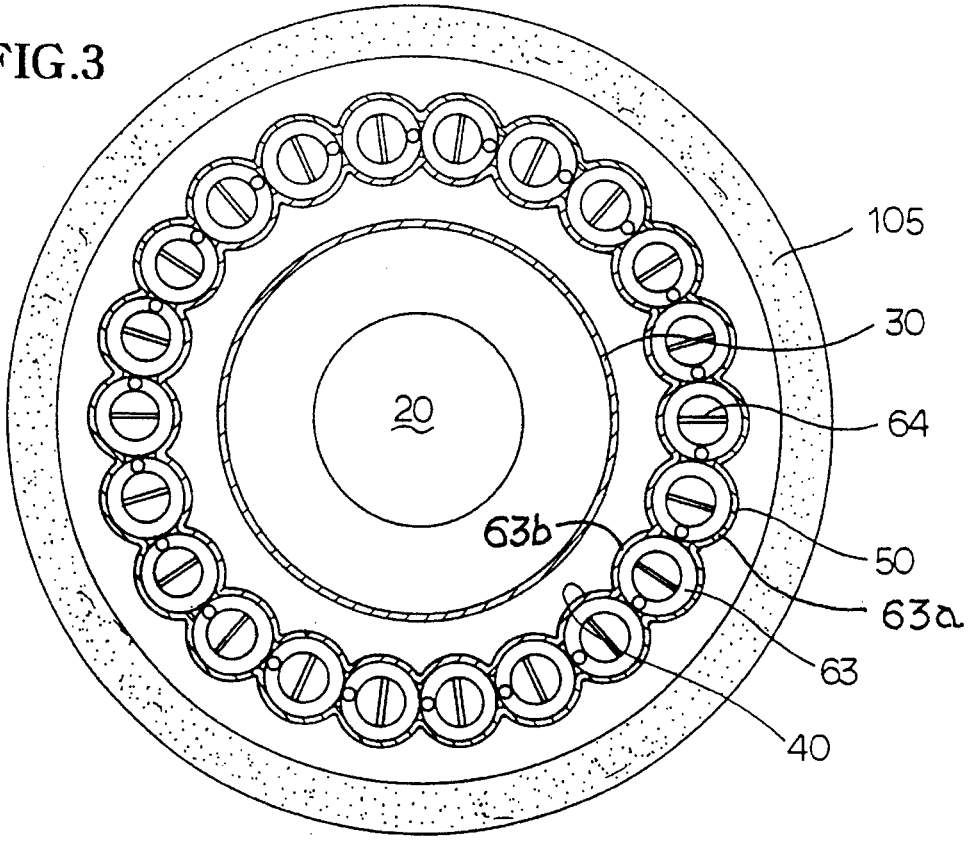
FIG. 3 is a cross-sectional view of the present invention cut along line 3—3 of FIG. 2.

As shown in FIGS. 2 and 3, a pleated cylindrical outer liner 50 is installed outside heat exchanger 60 and constructed so that the radially outer surfaces 63*a* of the coils of the plurality of annularly-disposed heat exchanging tubes 63 are closely embraced and the lower one side of the liner has an opening 50*a* communicating with exhaust fan 70.

A pleated cylindrical inner liner 40 is installed inside heat exchanger 60 and constructed so that the radially inner surfaces 63*b* of the coils of the plurality of heat exchanging tubes 63 are closely embraced. The height of the inner liner 40 is designed to be lower than outer liner 50. A burner 20 and a combustion barrel 30 are installed inside inner liner 40.

A lower plate 35 which closes a lower surface between inner and outer liners 40 and 50 and has an air intake 35*a* at the center, is attached to the lower portions of inner and outer liners 40 and 50.

A swirl plate 33 having a plurality of air intakes 33*a* at the periphery and a gas hole 33*b* at the center portion is installed in the middle of inner liner 40.

Combustion barrel 30 is installed in swirl plate 33 concentrically with burner 20 and spaced apart from the inner surface of inner liner 40 by a predetermined interval. A plurality of air intakes 30*a* are formed throughout combustion barrel 30.

A guide bent in one direction for rotating air entering combustion barrel 30 in a swirl form is provided in air intakes 33*a* of swirl plate 33 and air intakes 30*a* of combustion barrel 30.

Exhaust fan 70 is installed on barrier 102 in first space 103 so that burned gas is discharged outside through opening 50*a* of outer liner 50 and exhaust port 102*a* formed on barrier 102.

In this configuration, air enters inner liner 40 through intake 35*a* of lower plate 35 by exhaust fan 70 and enters combustion barrel 30 through air intake 33*a* of swirl plate 33 and air intake 30*a* of combustion barrel 30 to be heated and raised. Then, this raised air is lowered through a space placed between inner and outer liners 40 and 50 and discharged outside through opening 50*a* of outer liner 50 and exhaust port 102*a* of barrier 102.

An insulation member 105 is provided on the side and top of heat exchanger 60, while being spaced apart from the outer side and top of outer liner 50 by a predetermined distance. The lower portion of insulation member 105 is open so that annular air intake 105*a* is formed between it and outer liner 50. Part of the air is supplied to the upper portion of heat exchanger 60 through air intake 105*a* and through a space between outer liner 50 and insulation member 105, and thereby mixed with heated air.

Figure 4A:
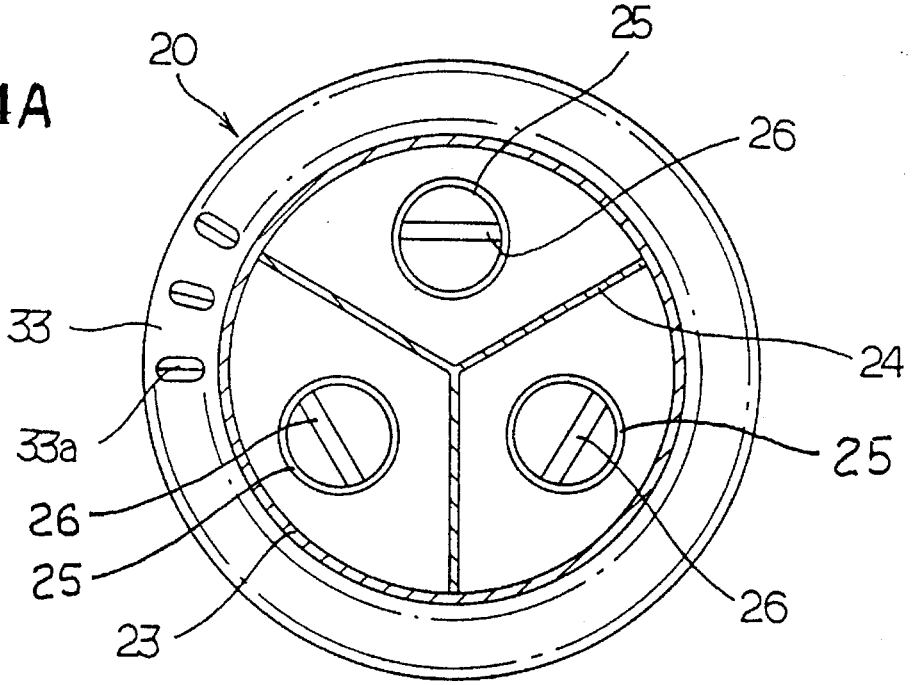
FIG. 4A is a plan sectional view of a burner, which is an important component of the present invention.
Figure 4B:
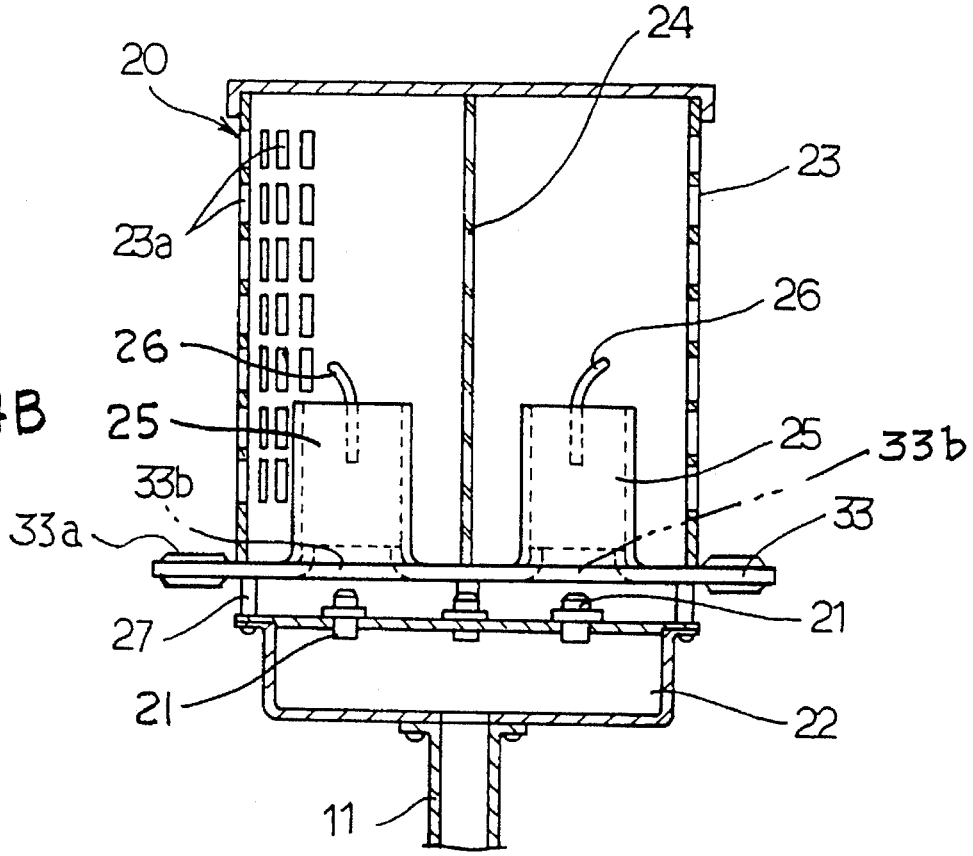
FIG. 4B is a front sectional view of the burner.

Burner 20, as shown in FIGS. 4A and 4B, comprises a gas chamber 22 for storing gas supplied through gas supply pipe 11, a plurality of nozzles 21 installed on the upper wall of gas chamber 22, a flame holder 23 divided by a barrier 24 and formed with a plurality of flame holes 23*a*, a gas-air mixing pipe 25 installed on swirl plate 33 placed on the inner bottom of each divided space of flame holder 23 and installed to coincide with the corresponding gas hole 33*b* of swirl plate 33. A guide 26 bent outward on the upper portion of each pipe 25, and a spacer 27 for spacing gas chamber 22 and swirl plate 33 by a predetermined distance. An ignition rod (not shown) is installed around flame holder 23.

As shown in FIG. 2, a catalyst 31 for accelerating the combustion of imperfectly burned gas is installed on the upper portion of combustion barrel 30 by a catalyst installation plate 32.

In this invention, the rotation speed of exhaust fan 70 and a gas supply amount are controlled in proportion to the flow amount of hot water being used and an established temperature of hot water. In order to detect the flow amount of hot water being used, flow amount detector 80 for detecting the flow amount of cold water entering is installed on cold-water supply pipe 81. In order to detect the temperature of hot water, a respective thermistor 106 is installed on two hot-water supply pipes. Exhaust fan 70 is employed so that its rotation speed is varied in proportion to the flow amount of hot water detected by flow amount detector 80, that is, the flow amount of cold water entering, and the established temperature of hot water. A gas valve 10 for automatically controlling a gas supply amount in inverse proportion to the intake pressure of exhaust fan 70 is installed on gas supply pipe 11. The intake pressure of exhaust fan 70 is detected by a pressure sensor (not shown) which can be installed, for instance, between exhaust port 102*a* of barrier 102 and opening 50*a* of outer liner 50.

A lower intake pressure(pressure of space between exhaust port 102*a* and opening 50*a*) indicates that the rotation speed of exhaust fan 70 becomes faster to increase the amount of air flow passing through heat exchanger 60. Here, the gas supply amount increases corresponding to the air flow amount.

Conversely, a higher intake pressure of exhaust fan 70 indicates that the rotation speed of exhaust fan 70 becomes slower to decrease the air flow amount passing through heat exchanger 60. Here, the gas supply amount decreases corresponding to the air flow amount.

A controller for varying the rotation speed of exhaust fan 70 in proportion to the flow amount of entering cold water detected by flow amount detector 80 and automatically controlling the gas supply amount of gas valve 10 in inverse proportion to the intake pressure of exhaust fan 70 can be easily realized by one skilled in the art and therefore detailed description thereof will be omitted.

Further, flow amount detector 80 for detecting the flow amount of cold water entering, exhaust fan 70 whose rotation speed is varied in proportion to the amount of cold water being entered and an established temperature of hot water, and gas valve 10 for automatically controlling a gas supply amount are commercially available in several kinds and detailed description thereof will be also omitted.

Mixing valve 90 which can simply supply hot water or supply the hot water with cold water mixed is installed in first space 103 and connected to upper manifold 61 of heat exchanger 60. This kind of mixing valve 90 is well-known and will be omitted in detailed description.

The operation of the gas quick water heater of the present invention will be presented below.

Gas is supplied through gas supply pipe 11 and cold water is supplied through cold-water supply pipe 81. When burner 20 and exhaust fan 70 operate, quick water heater 100 operates.

Cold water is supplied to lower manifold 62 through cold-water intake 62*a* and raised to upper manifold 61 through a plurality of coil-shaped heat exchanging tubes 63. Air enters inner liner 40 through intake 35*a* of lower plate 35 by the operation of exhaust fan 70 and creates a swirl through air intake 33*a* of swirl plate 33 and air intake 30*a* of combustion barrel 30. Then, the air enters combustion barrel 30. The air of combustion barrel 30 is mixed and burned with gas to thereby be heated and raised. The raised air is next lowered through a space between inner and outer liners 40 and 50 and discharged through opening 50*a* of outer liner 50 and exhaust port 102*a* of barrier 102.

Heat exchange is performed between the cold water being raised in heat exchanging tubes 63 and heated air being lowered in space between inner and outer liners 40 and 50 so that the cold water is heated. Since heat exchanging tubes 63 are coil-shaped, water moves at a slow speed. Heated air is delayed by baffle plate 64 installed in the center of heat exchanging tubes 63 when flowing between inner and outer liners 40 and 50. This enhances heat transmission efficiency because heat exchange is performed briskly between water and heated air.

External air comes into the upper portion of heat exchanger 60 through air intake 105*a* and a space between outer liner 50 and insulation member 105 by the operation of exhaust fan 70. The amount of external air coming through air intake 105*a* is comparatively small and the external air coming into the upper portion of heat exchanger 60 lowers the temperature of high-temperature air heated by burner 20, to thereby prevent upper manifold 61 and heat exchanging tubes 63 from being damaged due to the high temperature.

Gas which is stored temporarily in gas chamber 22 of burner 20, is ejected through each nozzle 21 and enters the respective mixing pipe 25 with air mixed. Mixed gas starts to be burned in flame holder 23 and enters combustion barrel 30 through flame holes 23*a*. Since part of the mixed gas is deflected outward by guide 26 installed in mixed pipe 25, the burned gas is uniformly ejected through all of flame holes 23*a* of flame holder 23. The gas is burned while being completely mixed with air entering combustion barrel 30 in a swirl form, greatly increasing combustion efficiency.

Since the gas of combustion barrel 30 passes through catalyst 31 for accelerating combustion, imperfectly burned gas is completely burned. Therefore, the combustion efficiency is further improved to obtain higher heat efficiency and not to discharge harmful gas.

The rotation speed of exhaust fan 70 and a gas supply amount to burner 20 are proportional to the flow amount of hot water being used, that is, the flow amount of cold water entering and an established temperature of hot water. The rotation speed of exhaust fan 70 is varied in proportion to the cold flow amount detected by flow amount detector 80 installed on cold-water supply pipe 81, that is, the flow amount of hot water and the established temperature of hot water being used. The gas supply amount of gas valve 10 is controlled according to the exhaust amount of exhaust fan 70.

Since the temperature and traveling speed of heated air increase proportional to the flow amount of hot water being used, hot water of an established temperature can be obtained regardless of the flow amount of hot water being used.

Supplied hot water is divided into two kinds of temperature by mixing valve 90 so that a lower-temperature hot water is used to take a shower and at the same time, a higher-temperature hot water is used to wash dishes.

Comparatively low air flows between inner liner 40 and combustion barrel 30, between outer liner 50 and insulation member 105, and on the upper portion of heat exchanger 60 and external air entering the upper portion of heat exchanger 60 lowers the temperature of high-temperature air heated by burner 20 so that heat exchanger 60 does not come into direct contact with the high-temperature heat. As a result, heat exchanger 60 is not corroded due to high temperature and this lengthens sharply its life.

What is claimed is:

1. A gas quick water heater comprising:

a casing divided into first and second spaces by a barrier, said barrier comprising an exhaust port;

a heat exchanger installed in said second space and having an annular lower manifold with a cold-water intake, an annular upper manifold with a hot-water exit, a plurality of coil-shaped heat exchanging tubes connected between said manifolds, and a baffle plate installed within space surrounded by coils of each of said heat exchanging tubes for delaying flow of burned gas through the coil-surrounded space of the respective tube, said tubes being circumferentially distributed in said heat exchanger such that coils of each tube have radially outer surfaces and radially inner surfaces;

an inner liner for closely embracing the radially inner surfaces of coils of each of said heat exchanging tubes;

an outer liner having a height greater than said inner liner for closely embracing the radially outer surfaces of coils of each of said heat exchanging tubes, said outer liner comprising an opening proximate said barrier's exhaust port;

a lower plate for closing a lower portion of said heat exchanger between said inner and outer liners and having an air intake at a center portion thereof;

a swirl plate, comprising a periphery and a center portion, installed interiorly of said inner liner and having a plurality of air intakes at said periphery and at least one gas hole at said center portion;

a combustion barrel installed on said swirl plate, spaced apart from said inner liner by a predetermined distance, and having a plurality of air intakes;

a gas burner installed within said combustion barrel;

an insulation member, comprising a side wall and a top wall that closes an upper end of said side wall, said insulation member being spaced apart from said outer liner to form an air passage having an annular air intake between a lower end of said side wall and said outer liner; and an exhaust fan installed in said first space for discharging burned gas through said opening of said outer liner and said exhaust port of said barrier.

2. A gas quick water heater as claimed in claim 1, wherein a catalyst for accelerating the combustion of imperfectly burned gas is provided on an upper portion of said combustion barrel.

3. A gas quick water heater as claimed in claim 1, wherein each said baffle plate is a ribbon-shaped plate out of both sides of which a plurality of wings are pressed.

4. A gas quick water heater as claimed in claim 1, wherein the air intakes of said swirl plate and combustion barrel have unidirectionally bent guides so that air enters said combustion barrel in a swirl form.

5. A gas quick water heater as claimed in claim 1, wherein said burner comprises a gas chamber for storing gas supplied through a gas supply pipe, said gas chamber comprising an upper wall, a plurality of nozzles installed on said upper wall of said gas chamber, a flame holder divided into spaces by a barrier means and having a bottom formed with a plurality of flame holes leading to said spaces, a mixing pipe installed on said swirl plate and placed on said bottom of said flame holder to coincide with a respective said gas hole of said swirl plate, each said mixing pipe having a guide bent outward on an upper portion thereof, and a spacer for spacing said gas chamber and swirl plate by a predetermined distance.

6. A gas quick water heater as claimed in claim 1, wherein a flow amount detector for detecting the flow amount of cold water entering said cold-water intake is installed on a cold-water supply pipe connected with said lower manifold, said exhaust fan is operated such that its rotation speed is varied in proportion to the flow amount of water detected by said flow amount detector and by an established temperature of hot water exiting said hot water exit, and a gas valve for automatically controlling a gas supply amount in inverse proportion to intake pressure of said exhaust fan is installed on said gas supply pipe.

7. A gas quick water heater as claimed in claim 1, wherein a mixing valve which can selectively supply hot water from solely said hot-water exit and hot water from said hot-water exit mixed with cold water, is installed in said upper manifold.

* * * * *